United States Patent [19]

Hardy

[11] Patent Number: 4,776,931

[45] Date of Patent: Oct. 11, 1988

[54] METHOD AND APPARATUS FOR RECOVERING METALS FROM SOLUTIONS

[75] Inventor: Tommy L. Hardy, Beaverton, Oreg.

[73] Assignee: Lab Systems, Inc., Vancouver, Wash.

[21] Appl. No.: 78,270

[22] Filed: Jul. 27, 1987

[51] Int. Cl.[4] ..... C25C 1/00

[52] U.S. Cl. ..... 204/105 R; 204/109; 204/278

[58] Field of Search ..... 204/228, 109, 105 R

[56] References Cited

U.S. PATENT DOCUMENTS

| | | | |
|---|---|---|---|
| 3,418,225 | 12/1968 | Wick et al. | 204/109 |
| 3,524,805 | 7/1970 | Engelman | 204/109 |
| 3,616,412 | 10/1971 | Gnage | 204/228 |
| 3,705,716 | 12/1972 | Hendrickson | 204/109 |
| 3,751,355 | 8/1973 | Mandroian | 204/228 |
| 3,875,032 | 4/1975 | Thompson | 204/109 |
| 3,925,184 | 12/1975 | Cave | 204/229 |
| 4,018,658 | 4/1977 | Alfin et al. | 204/109 |
| 4,026,784 | 5/1977 | Rivers | 204/273 |
| 4,127,465 | 11/1978 | Higgins | 204/228 |
| 4,280,884 | 7/1981 | Babb et al. | 204/109 |
| 4,302,318 | 11/1981 | Mock | 204/229 |
| 4,612,102 | 9/1986 | Brimo et al. | 204/228 |
| 4,619,749 | 10/1986 | Nusbaum | 204/228 |

OTHER PUBLICATIONS

Fairchild Linear Products Division Data Book, 1982, pp. 2-94-2-101.

*Primary Examiner*—R. L. Andrews

*Attorney, Agent, or Firm*—Klarquist, Sparkman, Campbell, Leigh & Whinston

[57] ABSTRACT

In an electrolytic method for removing metal from solution, a "plating" voltage applied to the electrodes is reduced to a lower, "standby" value if the current drawn by the solution falls below a threshold value. This "standby" voltage, however, is periodically restored to its higher, "plating" value for brief intervals so that the current at the higher voltage can periodically be sampled. If it is found that the current drawn by the solution at the higher voltage is once again above the threshold value (indicating that new metal has been added to the solution), the electrode voltage is kept at the higher level until the solution is again depleted of metal to the point that the current drops below the threshold. If, during the brief sampling interval, the current is still below the threshold, the electrode voltage is returned to its lower, "standby" value and another current sample is taken at the next interval. The electroplating power supply desirably provides a well regulated output voltage that is variable over a range of low voltages despite its use of simple conventional regulator circuits which are unable, by themselves, to provide output voltages in this range.

16 Claims, 2 Drawing Sheets

METHOD AND APPARATUS FOR RECOVERING METALS FROM SOLUTIONS

FIELD OF THE INVENTION

The present invention relates generally to recovery of metals from solutions, and more particularly relates to a method and apparatus for the electrolytic recovery of metals from solutions such as photographic processing baths and industrial waste water.

BACKGROUND AND SUMMARY OF THE INVENTION

It is well known in the art to recover metals from solutions by an electrolytic process. This process, simply stated, involves immersing a pair of electrodes in an electrolytic solution containing the metal to be recovered and impressing across the electrodes a voltage of sufficient magnitude to cause electrolytic deposition of the desired product.

This process has long been used in the recovery of silver from used photographic processing solutions. In the processing of exposed photographic films or papers, various silver salts employed in their manufacture are dissolved in the aqueous fixative or stop solutions as complex silver salts. If the silver content of these processing solutions is allowed to rise above a certain value, their chemical action becomes unsatisfactory. The solutions must then be replaced. By removing silver from the solutions while the processing is carried on, the life of the solutions can be greatly extended, thereby reducing the cost of the process. An added benefit is the revenue obtained from the sale of the recovered silver.

Prior art electrolytic methods for recovering silver from film processing solutions have suffered from a number of drawbacks. One is the contamination of the processing solution. Another is the release of obnoxious gases. As the concentration of silver in solution is reduced, the electroplating current is carried increasingly by sulphate ions, resulting in the disintegration of these ions into sulfide ions and other complex ions of varying nature. This decomposition contaminates the processing solution, as the sulfide ions attack the plated silver to produce a silver sulfide. The resulting impairment of the purity of the silver is accompanied by the release of hydrogen sulfide gas.

Attempts to control the plating current to minimize these drawbacks have met with only limited success. For example, U.S. Pat. No. 3,875,032 to Thompson shows a system for measuring the concentration of silver in solution using dedicated measuring electrodes which are excited with a fixed voltage. The resultant current is used to control the current applied to the primary plating electrodes. Similarly, U.S. Pat. No. 3,616,412 to Gnage shows a system for measuring silver concentration by determining the time required for the resistance between two cathodes in the solution to drop below a predetermined value. This measurement is then used to control plating current flow. Both of these systems, however, still result in some contamination of the solution and in the release of hydrogen sulfide gas due to their occasional use of high plating voltages.

U.S. Pat. No. 4,612,102 to Brimo discloses an electroplating power supply employing two current set points, one high (e.g. 0.85 amperes) and one low (e.g. 0.2 amperes). When the current delivered to the electrodes exceeds the high set point, the circuit considers there to be enough silver in solution for electroplating to occur. As plating continues and silver is removed from solution, the amperage drops. When it drops below 0.85 amperes, the apparatus causes the applied voltage to drop, dropping the associated current to a level below the low set point (e.g. 0.1 amperes). However, the circuit continues to monitor current and when the current at this low voltage rises above the low set point (0.2 amperes), the circuit kicks back into high voltage (and current), i.e., into the plating mode. In this mode, the plating process continues until the amperage drops again below the high set point and the control recycles as before.

The Brimo system suffers from a number of problems. One is the sensitivity, and thus the inaccuracy, of the set points, thereby making system control somewhat inaccurate and unreliable. Another is that there can be quite a buildup of metal in solution from the time the circuit drops into its low voltage mode until it kicks back into its high voltage plating mode. In other words, no plating occurs from the time the amperage drops below 0.85 amperes at high voltage and the time, at low voltage, the amperage rises above 0.2 amperes. During this interval, metal can build up in solution. Since most photographic processes continuously add and remove solution, valuable silver can be lost if the solution removed from the system contains more than a very nominal amount of silver.

Another problem characteristic of prior art systems, which employ a standby state such as Brimo's, arises in the processing of color film fixing solutions. Color film processing uses a bleach which becomes part of the fixing solution. In systems employing a standby state, the bleach removes silver from the cathode during the standby period and thereby reduces the silver recovery.

The prior art also includes various techniques for timing the electroplating process to correspond to the processing of films by a processing apparatus. For example, U.S. Pat. No. 4,280,884 to Babb, et al. normally applies an "idling" current of 0.5 amperes to the plating cathode, which is stepped up to 3 amperes when the film processor is activated by the introduction of film. The current returns to its 0.5 ampere idle value when the processor becomes inactive. Similarly, U.S. Pat. No. 4,026,784 to Rivers shows a timer that activates the plating power supply for a predetermined time period when a new roll of film is introduced into an associated film processor. These techniques, however, suffer in that the electroplating process is not controlled directly by the silver concentration in solution, but rather is controlled indirectly by the introduction of film into the processor. The amount of plating current and the length of time it must be applied to completely plate the metal from solution without contaminating the solution or producing hydrogen sulfide gas can only be estimated in advance. These systems employ no feedback to respond to actual plating conditions.

From the foregoing it will be recognized that the prior art electroplating techniques suffer from a variety of drawbacks.

Accordingly, it is a principal object of the present invention to provide a method and apparatus for efficiently electroplating metal from solution that overcomes drawbacks found in the prior art.

It is another object of the present invention to sense the presence of a predetermined concentration of metal salts in a solution and thereupon switch a plating process to an active state in which metal is plated from the solution.

It is a further object of the present invention to sense depletion of metal salts in a solution and thereupon switch a plating process to a standby state in which metal is neither plated from nor leached back into solution.

It is yet another object of the present invention to provide a variable interval at which the concentration of metallic salts in solution is detected when a plating process is in a standby state.

It is still another object of the present invention to provide a simple regulated plating power supply adjustable over at least a portion of the range zero to two volts.

It is yet another object of the present invention to efficiently plate metallic salts out of solution without generating gaseous byproducts or contaminating the solution.

It is still another object of the present invention to temperature compensate a plating power supply to assure uniform operation.

It is yet another object of the present invention to provide a plating system having adjustable output voltages in the plating and standby modes.

It is still another object of the present invention to achieve the foregoing objects with overcurrent protection.

The present invention achieves these objects, and overcomes deficiencies of the prior art, by providing novel techniques for the efficient and automated extraction of metals from solutions. In the preferred embodiment, the "plating" voltage is removed from the electrodes if the current drawn by the solution falls below a threshold value. Thereafter, a lower "standby" voltage is applied to the electrodes. This lower voltage, however, is periodically restored to its higher "plating" value for brief intervals so that the current at the higher voltage can periodically be sampled. If it is found that the current is once again above the threshold value (indicating that new metal has been added to the solution) the electrode voltage is kept at the higher level until the solution is again depleted of metal to the point that the current drops below the threshold. If, during the brief sampling interval, the current is still below the threshold, the electrode voltage is returned to its lower, "standby" value and another current sample is taken at the next interval. The electroplating power supply desirably provides a well regulated output voltage that is variable over a range of low voltages despite its use of conventional regulator circuits which are unable, by themselves, to provide output voltages in this range.

The regulation of the plating voltage is important if the full benefits of the present invention are to be achieved. If the plating voltage varies due to power line fluctuations or other such causes, the current drawn by the solution would vary proportionately. Such variations could cause the device to erroneously switch from its plating mode to standby mode, or vice versa. Regulation of the plating voltage assures that such mode switching is entirely a function of metals concentration and is not influenced by extraneous factors.

The low plating voltage is also an important aspect of the present invention. The rate at which plating occurs is a function of many factors, but is principally dependent on the concentration of metal in solution and on the plating voltage. The plating voltage, however, cannot be set to an arbitrarily high value because high plating voltages (more than a few volts) introduce several serious problems. As mentioned earlier, one problem is the production of undesirable byproducts, such as silver sulfide and hydrogen sulfide. Another is the undesired plating of other metal objects which may be in contact with the solution, such as metal pipes and the like. Accordingly, despite the tradeoff in plating rate, it is generally desirable to plate with low voltages, such as voltages on the order of one volt. As noted, adjustable regulated power supplies in this voltage range have heretofore been impractical due to the unavailability of low voltage integrated circuit regulators.

Even at the low plating voltage employed by the present invention, damage to both the solution and the power supply itself can occur if certain precautions are not taken. For example, as metal is added to a solution, the conductivity of the solution increases. When this occurs during the plating process, the plating amperage increases proportionately to match the conductivity of the solution. It is contemplated that the amperage of each power supply produced according to the present invention will be limited so as to avoid damage to the particular chemistry in the solutions utilized.

In the event that the metal salts cause a short circuit between the negative and positive plating terminals, the plating amperage would theoretically reach an infinite level. This, of course, would destroy tee power supply. The apparatus of the present invention is able to withstand a continuous shorted condition, or high level plating current, for an indefinite period without sustaining damage.

Unlike prior art devices which apply a plating period for a predetermined time period based on the introduction of film into a processing apparatus, the present invention responds directly to an increase in metals content in the solution. The process then continues to plate metal out of solution until the concentration drops below a predetermined value. The present invention does not rely on projections or estimates of how much current must be applied for how long in order to effect complete metal recovery without contaminating the solution nor producing harmful gases. The system's reliability is enhanced by eliminating the need to provide control circuitry linking the electroplating process to the film processing apparatus.

Metals recovery from color film processing solutions is also enhanced with the present invention. Circuitry can be provided to operate a valve or pump to remove silver-depleted solution from the system before the bleach in the solution has a chance to dissolve the silver from the electrode. In prior art systems such as Brimo, such a technique would flush solution having a significiant quantity of silver from the system.

The method and apparatus of the present invention can readily be used to recover copper, gold, aluminum and the like from their salts in solution. For example, copper can be recovered from copper sulfate found in the effluent from the manufacture of printed boards. Such applications are becoming increasingly important as the Environmental Protection Agency is tightening its limits on metallic discharges in industrial waste water.

The foregoing and additional objects, features and advantages of the present invention will be more readily apparent from the following detailed description of a preferred embodiment thereof, which proceeds with reference to the accompanying drawings.

DETAILED DESCRIPTION OF A PREFERRED EMBODIMENT

Figure 1:
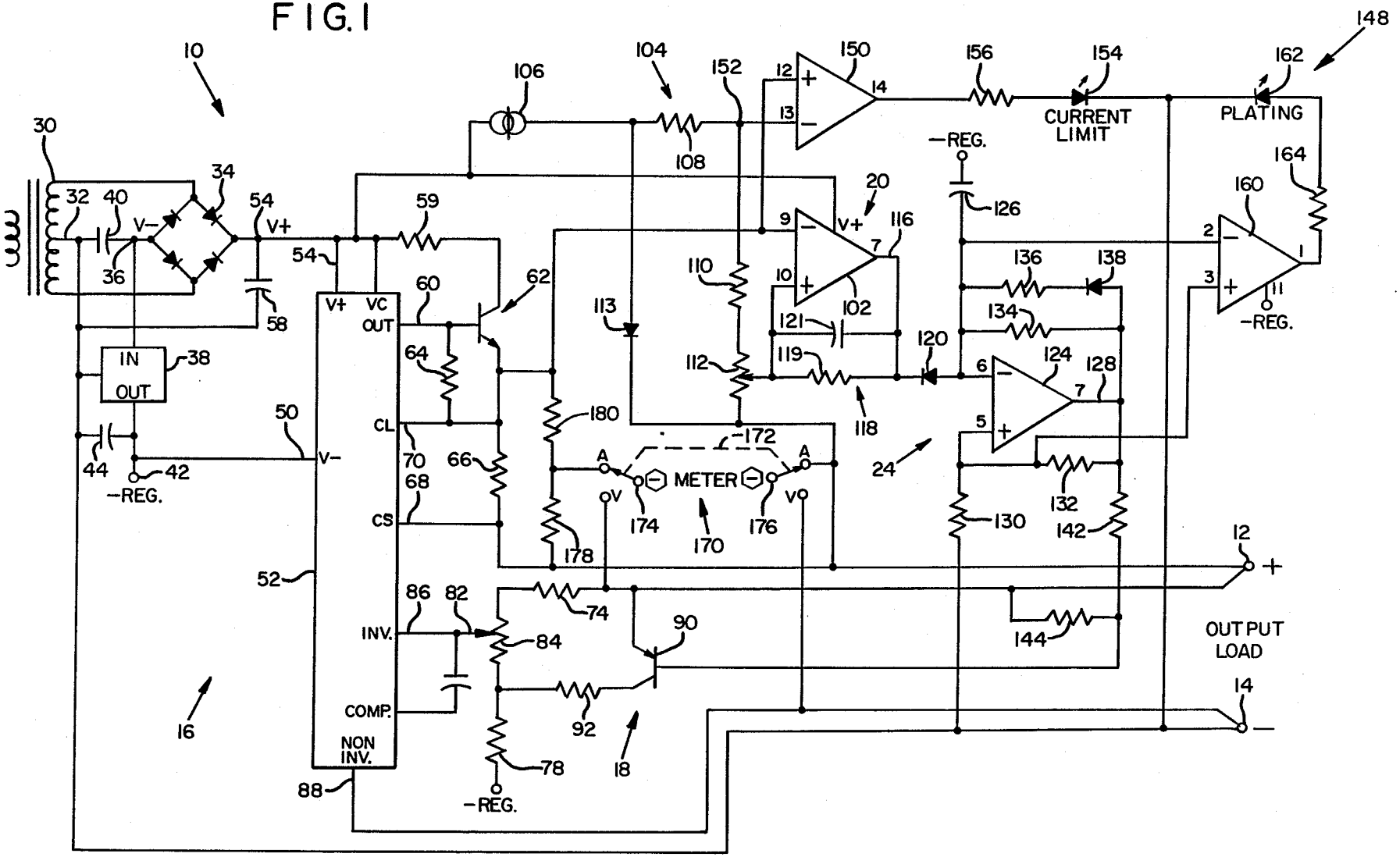
FIG. 1 is an electrical schematic diagram of a metals recovery apparatus according to the present invention.
Figure 2:
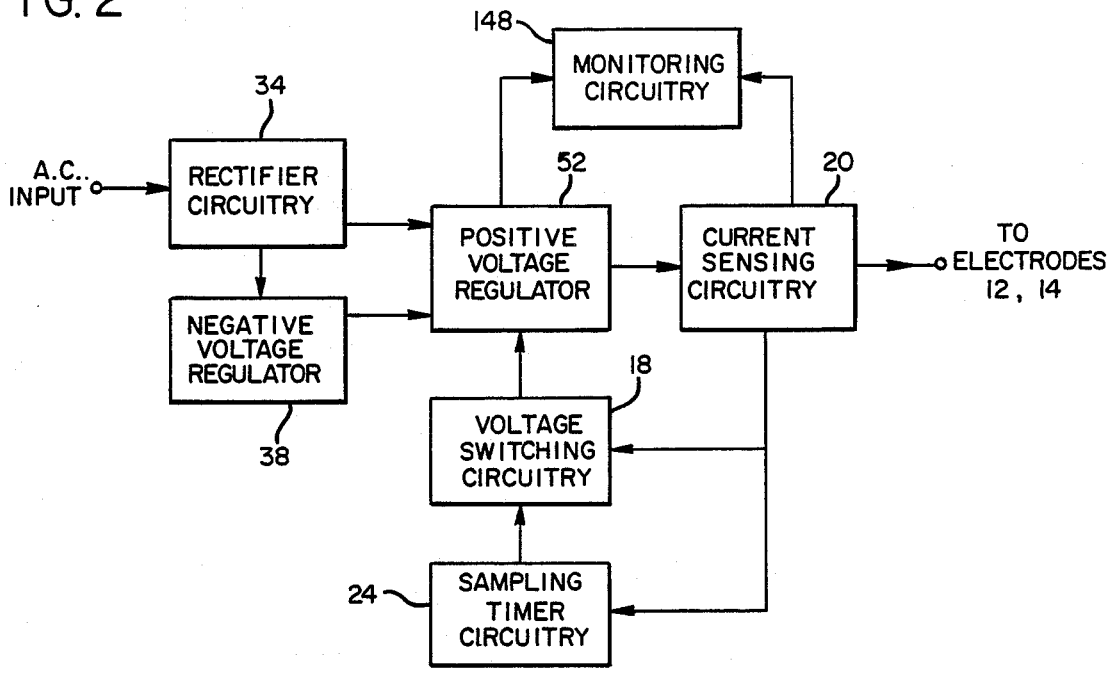
FIG. 2 is a simplified block diagram of the apparatus of FIG. 1.

With reference to FIGS. 1 and 2, a preferred embodiment of a metals recovery system 10 according to the present invention includes a pair of output terminals 12 and 14, a regulated DC supply 16 and a switching circuit 18 for applying either a "plating" voltage or a "standby" voltage from the regulated DC supply to the output terminals. The illustrated metals recovery system also includes a current sensing circuit 20 for sensing the current provided to first output terminal 12 from regulated DC supply 16 and for comparing this current against a threshold value. If this current drops below a threshold value, switching circuit 18 reduces the voltage applied to first output terminal 12 from the "plating" voltage to a lesser, "standby" voltage. In this standby mode of operation, a sampling circuit 24 periodically causes an increase in the voltage applied to first output terminal 12 from the "standby" voltage back up to the "plating" voltage and samples the current provided to the output terminal. If this sampled current exceeds the treshold value, switching circuit 18 and sampling circuit 24 stay in plating mode, restoring the voltage applied to first output terminal 12 back to the "plating" voltage from the "standby" voltage.

Regulation Circuits

In more detail, regulated DC supply 16 comprises a transformer 30 having a center tap 32 which is connected to second output terminal 14 and which, for purposes of this discussion, will be considered to be at ground potential. Transformer 30 typically converts a 120 volt AC input signal to a 12.6 volt AC output signal (6.3 volts either side of the center tap). A bridge rectifier 34 is connected to the output of transformer 30. Between a V− output 36 of bridge rectifier 34 and transformer center tap 32 is connected a first voltage regulator circuit 38 for providing a regulated negative output voltage (relative to the center tap of the transformer). In the illustrated embodiment, regulator circuit 38 is a type 7905 integrated circuit which provides a −5 volt DC regulated output to output terminal 42. The input voltage supplied to regulator 38 is full-wave rectified AC that has been filtered by a large filtering capacitor 40. The −5 volt signal provided at output terminal 42 of regulator 38 is filtered by a ten microfarad filtering capacitor 44 and is applied to a V− input terminal 50 of a second voltage regulator circuit 52.

Second voltage regulator circuit 52, which may be a Fairchild type uA723 device, provides a regulated output voltage of between approximately +3 volts to +15 volts (relative to the voltage applied to its V− input 50) to an output terminal 60. Since the voltage applied to V− input 50 is −5 v relative to output 14 and inverting input 86, regulator 52 provides an output voltage of between 0 and 10 volts relative to non-inverting terminal 80. By this arrangement, the output voltage available from second regulator circuit 52 is offset to a range that is not normally attainable with this or any other conventional regulator devices.

Second voltage regulator circuit 52 has a V+ input 54 which is connected to the V+ output 56 of bridge rectifier 34. This full-wave rectified signal is filtered by a large (22,000 microfarads) filtering capacitor 58. A one ohm (typical) current limiting resistor 59 connects the output of bridge rectifier 54 to a current pass transistor 62 and serves to limit the maximum current drawn from transformer 30 in the event that ouput terminal 60 is shorted to V+ or pass transistor 62 fails.

The output from second voltage regulator circuit 52 is taken from output terminal 60 and is coupled to current pass transistor 62. Pass transistor 62 may be either a bipolar or a field effect transistor. The IRFZ20 transistor manufactured by International Rectifier Corp. is a suitable device. A 10 kilohm resistor 64 biases current pass transistor 62 so as to allow it to more fully turn off in low current conditions, discussed below.

The regulated output current passing through transistor 62 is fed through a current sensing resistor 66. The voltage developed across current sensing resistor 66 is applied across the Current Sense and Current Limit inputs 68, 70 of regulator 52. Regulator 52 is configured so that if the voltage applied across these terminals 68, 70 tries to exceed approximately 0.6 volts, the regulator will reduce its output voltage as necessary to constrain this voltage drop to a maximum of 0.6 volts. By adjusting the value of current sensing resistor 66 (here 0.2 ohms), the point at which regulator 52 limits current can be adjusted. The voltage regulating current passing through current sensing resistor 66 is then applied directly to first outpu terminal 12.

Coupled to regulator 52 is switching circuit 18 that determines both the "plating" voltage and the "standby" voltage. Circuit 18 includes a voltage divider circuit comprising a 1.5 kilohm resistor 74, a 10 kilohm resistor 78 and a 1 kilohm potentiometer 84 tied between first output terminal 12 and the −5 volt output 42 of first voltage regulator circuit 38. A tap 82 on potentiometer 84 is tied to an inverting input 86 of a differential error amplifier internal to second voltage regulator circuit 52. The non-inverting input 88 of this differential error amplifier is connected to second output terminal 14 (which, as noted, is tied to circuit ground). Operation of second voltage regulator 52 is such that it will strive to minimize the difference between the voltages applied to the inverting and non-inverting inputs. Consequently, regulator 52 will adjust its output voltage so that the voltage applied to inverting input 86 from potentiometer 84 equals zero volts (the voltage applied to non-inverting input 88). By adjusting potentiometer 84 appropriately, voltage regulator circuit 52 can produce an output "plating" voltage ranging from 0 volts to +10 volts DC. (As discussed more fully below, the output voltage is reduced to a "standby" value by energizing a switching transistor 90 to shunt a 4.7 kilohm resistor 92 across the series combination of resistor 74 and potentiometer 84.)

The adjustability of the output voltage from regulator 52 is desirable because the electrical characteristics of the plating electrodes vary as plating proceeds. Consequently, while a plating voltage of 1.3 volts might be used initially, it can soon be adjusted down to about 0.9 volts once the electrodes have been plated.

Current Sensing Circuit

As mentioned earlier, a current sensing circuit 20 is provided to sense the current supplied to first output terminal 12 and to switch the system to a standby mode if this current is below a threshold value. This is accomplished by monitoring the voltage drop across current sensing resistor 66. The voltage at the top side of resistor 66 is applied to an inverting input of a first operational amplifier 102 configured as a comparator. (Operational amplifier 102, as well as the other operational amplifiers illustrated, may be single sections of a quad op amp such as the LM324 marketed by National Semiconductor.) The other, non-inverting input of comparator 102 is driven by a voltage divider circuit 104 connected at one end to the bottom side of current sensing resistor 66 and excited at the other end with 0.6 volts.

Voltage divider circuit 104 includes a FET constant current source 106 driving a diode 113 shunted by series connected voltage dropping resistors 108 and 110 and potentiometer 112. These components may have values of 270 ohms, 2.2 kilohms, and 1 kilohm, respectively. Diode 113 (which can be a 1N4004) provides the forward voltage drop of approximately 0.6 volts which is divided by the series connected resistors. Potentiometer 112 sets the fraction of this 0.6 volt signal that is applied to the non-inverting input of comparator 102 and is the voltage against which the voltage across current sensing resistor 66 is compared.

By setting potentiometer 112 appropriately, the current at which the system switches to "standby" mode can be adjusted. Normally, potentiometer 112 is set to switch the system to "standby" when the last recoverable metal in the solution has been removed. By this arrangement, the introduction of any new metal into the solution prompts the apparatus to switch into "plating" mode to remove it. The particular threshold current will be a function principally of the liquid's conductivity and of the electrode geometry. In a typical embodiment it may be set to approximately 0.9 amperes.

While diode 113 provides an approximately 0.6 volt drop, its precise voltage drop is a function of temperature. When the temperature increases, the voltage drop across the PN junction decreases. Conversely, when the temperature decreases, the voltage drop across the diode increases. By this mechanism, temperature compensation of the circuit is obtained. For example, when the temperature in the power supply increases, the voltage applied to the non-inverting input of first comparator 102 decreases. Similarly, when the temperature in the power supply decreases, the voltage applied to the non-inverting input of comparator 102 increases.

When the voltage drop across current sensing resistor 66 falls below the voltage provided by voltage divider 104 to the inverting input of current sensing comparator 102 (indicating that the current supplied to first output terminal 12 has fallen below the threshold value), the output 116 of the comparator goes fully positive. (In the illustrated embodiment, all operational amplifiers are powered from the filtered output 56 of bridge rectifier 34 and by the −5 v output from terminal 42 of voltage regulator 38). This fully positive voltage (about ten volts) on output 116 of comparator 102 is fed back to potentiometer 112 through a feedback network 118 comprised of a 3 megohm resistor 119 and a 0.01 microfarad resistor 121. This positive feedback voltage tends to further increase the voltage differential across the inputs of comparator 102, turning the comparator further on. This feedback introduces a hysteresis component that must be overcome for the comparator to be turned off again. It is this hysteresis that prevents the system from oscillating rapidly on and off when current crosses the switching threshold. This hysteresis component also determines the smallest change in solution conductivity required to toggle the system from plating to standby, or vice versa. Feedback network 118 can theoretically be selected so that an infinitesimally small increase in metals content causes the system to switch to its plating mode and remove newly added metal. Alternately, network 118 can be omitted entirely.

Voltage Switching and Sampling Timer Circuits

As noted earlier, current sensing circuit 20 is coupled to a voltage switching circuit 18 which serves to reduce the voltage applied to output terminals 12, 14 when the current drawn by the metallic solution drops below the threshold value. Voltage switching circuit 18 comprises a 2N4403 switching transistor 90 driven by a sampling timer circuit 24 which is in turn enabled by current sensing comparator 102.

When the current drawn by the metallic solution is above the threshold value, the output of current sensing comparator 102 is low (−5 volts). This output signal is applied through a 1N4148 diode 120 to an inverting input of a second, sampling comparator 124, causing the output of that comparator to be high. This positive output signal is applied to the base of transistor 90 through a voltage divider including a 10 kilohm resistor 142 and a 4.7 kilohm resistor 144, thereby back biasing the transistor and keeping it in its off state.

When the metal salts in the solution are depleted, the electroplating current drops, thereby causing the output of current sensing comparator 102 to swing high. This change in the output of comparator 102 back biases coupling diode 120 and allows the voltage on the inverting input of sampling comparator 124 to climb positive at a rate determined by the RC time constant of a 10 microfarad capacitor 126 and a 1 kilohm resistor 136. This time constant is on the order of 10 milliseconds. When the voltage on the inverting input of sampling comparator 124 crosses a threshold voltage applied to its non-inverting input (determined by 27 kilohm resistors 130, 132), the output of the sampling comparator changes state, dropping to −5 volts. This negative voltage biases transistor 90 on, shunting resistor 92 across the series combination of resistor 74 and potentiometer 84. The shunting of this resistance disrupts the equilibrium in the differential error amplifier internal to second voltage regulator 52 and causes the regulator to adjust its output to restore the voltage applied to its input 86 to equal the voltage applied to its input 88 (here ground). To do this, voltage regulator 52 must reduce its output voltage. With the components illustrated, the ouput voltage must be reduced to approximately two-thirds of its original value, or to approximately 0.6 volts. This is the "standby" voltage which is applied to output terminals 12, 14. This voltage is determined by the value of resistor 92 and is selected so that metal is neither plated from, nor leached back into the electrolytic solution.

While the apparatus is in this "standby" mode, the voltage applied to terminals 12, 14 is periodically restored to its "plating" value for brief intervals so that the current at the plating voltage can periodically be sampled. In standby mode, output 128 of sampling comparator 124 is low, back biasing a 1N4148 switching diode 138 and effectively taking resistor 136 out of the circuit. The negative voltage on output 128 of comparator 124 is fed back to its non-inverting input through resistor 132, thereby reducing the voltage at this input. After a predetermined time period, dependent upon the value of capacitor 126 and a 330 kilohm timing resistor 134, the inverting input of comparator 124 drops below the voltage applied to the non-inverting input. This time constant is here selected to be on the order of ten seconds. When the voltage at the inverting input drops below the voltage at the non-inverting input, sampling comparator 124 momentarily swings its output high, turning off transistor 90 and restoring the output voltage to its "plating" value. If the concentration of metal in solution is still low enough that the current drawn is below the threshold value, current sensing comparator 102 will not change states. In this case, sampling comparator 124 soon switches back to its standby state after its inverting input has dropped below its non-inverting input due to the action of resistor 136 and capacitor 126. Again, this time period is on the order of ten milliseconds. If, however, the current drawn during this brief period at the plating voltage is above the threshold set by potentiometer 112, the output of current sensing comparator 102 will swing low again. In this case, diode 120 will be forward biased, tying the inverting input of sampling comparator 124 to the negative voltage output by current sensing comparator 102. In this state, the power supply remains in its "plating" mode until the current again drops below the threshold.

Figure 3:
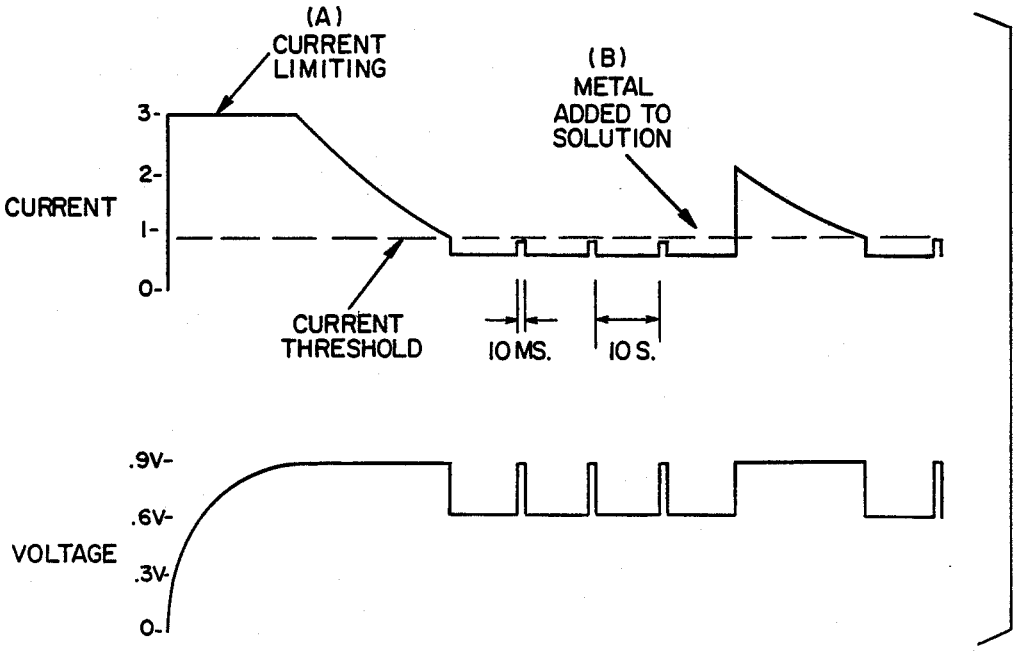
FIG. 3 is a graph showing the current and voltage applied to the plating electrodes as a function of time in an exemplary plating operation.

FIG. 3 is a graph showing, in exaggerated fashion, the operation of the apparatus. In the region labeled "A", the apparatus has just been turned on and is operating at its current limiting threshold as it removes metal from the initially highly concentrated solution. After a period, the metal concentration is reduced to the point that the supply no longer limits current, but instead applies a regulated 0.9 volt signal across terminals 12, 14 and allows the solution to draw a current dependent on its concentration. At some point, the concentration of metal in solution is depleted to the point that the current drawn by the solution drops below the 0.9 ampere threshold set by potentiometer 112. At this point, the apparatus switches to standby mode.

In standby mode, the shunting of resistor 92 across resistor 74 and potentiometer 84 causes the voltage provided by regulator 52 to drop to a lower value, here 0.3 volts. At this lower voltage, the current drawn by the solution is reduced correspondingly. At ten second intervals, however, the voltage is briefly restored to its 0.9 volt value so that the current at this voltage can be sampled. So long as the sampled current is below the 0.9 ampere threshold, the apparatus quickly returns to its low voltage state.

During one of these ten-second intervals, labeled "B" in FIG. 3, metal has been added to the solution. The next time the current at the higher voltage is sampled, it is found to exceed the 0.9 ampere threshold. In this condition, the apparatus resumes continuous application of the 0.9 volt plating voltage to terminals 12, 14 until the metal newly added to the solution has been depleted, at which time the system returns to its intermittently sampling standby state. Thus, it will be recognized that the system automatically detects the addition of metal to the solution and proceeds to remove it from solution before returning to its standby state.

Monitoring Circuitry

The remaining circuitry 148 illustrated in FIG. 1 is principally for operator convenience and allows monitoring of the apparatus' operation. A third comparator 150 compares the voltage across resistor 66 with the voltage established by a tap 152 on voltage divider circuit 104. Component values are selected so that the voltage applied to the inverting input of third comparator 150 is just slightly less than the voltage drop across diode 113 (that is, just slightly less than 0.6 volts). When the voltage applied to the non-inverting input of third comparator 150 exceeds this value (that is, when the voltage drop across current sensing resistor 66 approaches 0.6 volts), the output of third comparator 150 goes high, which in turn drives a "CURRENT LIMITING" LED 154 through a resistor 156. Thus, third comparator 150 simply informs the operator when the voltage drop across current sensing resistor 66 is very near 0.6 volts. As noted earlier, when the voltage drop across resistor 66 reaches 0.6 volts, voltage regulator 52 limits its output current by reducing its output voltage.

A fourth comparator 160 provides an indication to the operator when the apparatus is in a plating mode. The inputs of fourth comparator 160 are connected to the corresponding inputs of sampling comparator 124, so the fourth comparator simply mimics the sampling comparator's state. Consequently, when the apparatus is in plating mode, the output of fourth comparator 160 goes high, which in turn drives a "PLATING" LED 162 through a current limiting resistor 164. Conversely, when the apparatus is in standby mode, the output of fourth comparator 160 goes low, extinguishing LED 162.

A metering circuit 170 is also provided for operator convenience. A double pole, double throw switch 172 allows a voltmeter to be connected across terminals 174, 176 to measure either the voltage applied to the electrolyte solution or the current drawn thereby. When measuring voltage, terminals 174, 176 are connected directly across first and second output terminals 12, 14. When measuring current, terminals 174, 176 are connected across a 1 kilohm resistor 178 that is connected in series with resistor 180 to measure its voltage drop. This voltage is proportional to the voltage across current sensing resistor 66, which in turn is proportional to the current drawn by the circuit. The value of resistors 178 and 180 are chosen to produce a desired correspondence between the voltmeter reading and the current being drawn.

Alternative Embodiments

It will be recognized by those skilled in the art that the invention can be modified in arrangement and detail without departing from the principles thereof. For example, although the present embodiment is illustrated with reference to a type uA723 voltage regulator, a number of alternative systems could be used. Similarly, it will be recognized that the sampling feature of the present invention can be adapted for use in a variety of other electroplating systems that do not employ a power supply of the type here illustrated. For example, the sampling feature can advantageously be employed into systems such as are shown in U.S. Pat. Nos. 3,616,412; 3,875,032; 3,925,184; 4,018,658; and 4,619,749; in which the plating voltage (or current) is controllably varied to correspond to the instantaneous silver concentration. Conversely, the regulated low voltage power supply of the present invention can be used in systems which do not employ a sampling feature such as described herein. Accordingly, I claim as my invention all modifications coming within the scope and spirit of the following claims and equivalents thereof.

I claim:

1. In an electrolytic method for removing metal from a solution including the step of applying across an anode and a cathode immersed in the solution a desired "plating" voltage sufficient to cause the metal to be plated from solution onto the cathode, an improvement comprising the step: applying the "plating" voltage to the solution only intermittently until the current drawn by the solution when the "plating" voltage is applied exceeds a predetermined threshold.

2. The invention of claim 1 which further comprises the step: continuously applying the "plating" voltage to the solution until the current drawn by the solution when the "plating" voltage is applied falls below a predetermined threshold.

3. The invention of claim 1 which further comprises the step: applying across the anode and the cathode a "standby" voltage less than the "plating" voltage but greater than zero when the "plating" voltage is not being applied so that the metal plated onto the cathode is deterred from being leached back into solution.

4. A simple, regulated electroplating power supply for the application of a variable voltage to a pair of electrodes in contact with a metal-laden solution comprising:

a transformer having an input for connection to a source of AC power and having an output;

a rectifier circuit having an input connected to the output of the transformer and having first and second outputs;

a first voltage regulator circuit having an input coupled to the first output of the rectifier circuit and having an output for providing a regulated negative output voltage; and a second voltage regulator circuit having inputs coupled to the second output of the rectifier circuit and to the output of the first voltage regulator circuit, for providing to one of said electrodes a regulated positive output voltage relative to the negative voltage output from said first voltage regulator circuit.

5. A simple, regulated electroplating power supply for the application of a variable voltage, including at least a portion of the range from zero to two volts, to a pair of electrodes in contact with a metal-laden solution according to the invention of claim 4, in which the first and second voltage regulator circuits comprise integrated circuit voltage regulators that are unable, each by themselves, to provide regulated output voltages in the zero to two volt range.

6. The invention of claim 4 in which at least one of said first and second voltage regulator circuits comprises a variable voltage integrated circuit regulator device.

7. In an apparatus for use in recovering metal from an electrolyte solution, the apparatus including a power supply for providing a desired "plating" voltage to electrodes in contact with the solution, an improvement comprising: means for applying the "plating" voltage only intermittently to the electrodes until the current drawn by the solution when the "plating" voltage is applied exceeds a predetermined threshold.

8. The invention of claim 7 which further includes time constant means for establishing a periodic interval at which the "plating" voltage is applied to the electrodes until the current drawn by the solution when the "plating" voltage is applied exceeds a predetermined threshold.

9. The invention of claim 7 which further comprises means for continuously applying the "plating" voltage to the solution until the current drawn by the solution when the "plating" voltage is applied falls below a predetermined threshold.

10. The invention of claim 7 which further comprises means for applying across the electrodes a "standby" voltage less than the "plating" voltage but greater than zero when the "plating" voltage is not being applied.

11. The invention of claim 10 which further comprises independently operable means for setting the magnitudes of the "plating" and "standby" voltages.

12. The invention of claim 7 which further includes current limiting means for limiting the current provided to the electrodes to a predetermined value regardless of the conductivity of the electrolyte solution.

13. An apparatus for use in recovering metal from an electrolyte solution comprising:

first and second output terminals for coupling to the electrolyte solution;

a regulated DC power supply comprising:

a transformer having a center tap connected to the second output terminal and having an output;

a rectifier circuit connected to the output of the transformer;

a first voltage regulator circuit coupled to the rectifier circuit for providing a regulated output voltage of a first polarity relative to the center tap of the transformer; and a second voltage regulator circuit coupled to the rectifier circuit and to the first voltage regulator circuit for providing a regulated output voltage of a polarity opposite said first polarity relative to the voltage output from said first voltage regulator circuit;

means for coupling energy from the second voltage regulator circuit to the first output terminal;

current sensing means for sensing the current provided from the second voltage regulator circuit to the first output terminal and for comparing said current against a threshold value;

switching means coupled to the current sensing means for controlling the magnitude of the voltage applied from the second voltage regulator circuit to the first output terminal, said switching means applying a "plating" voltage to the first output terminal so long as the current sensing means senses that the current exceeds the threshold value, said switching means applying a "standby" voltage less than the "plating" voltage to the first output terminal when current sensing means senses that the current is below the threshold value; and sampling means operative when the current provided to the first output terminal is less than the threshold value for periodically causing the switching means to increase the voltage applied from the second regulator circuit to the first output terminal back to the "plating" voltage so that the current sensing means can sample the current at the "plating" voltage.

14. An apparatus for recovering metal from solution, said apparatus having a standby state and a plating state, comprising:

plating means for applying a plating voltage to the solution when the conductivity of the solution exceeds a predetermine threshold;

standby means for applying a standby voltage lower than the plating voltage to the solution when the conductivity of the solution is below a predetermined threshold; and means for switching between the standby and plating states in response to the conductivity of the solution, said conductivity being detected in the standby state by means for monometarily applying the plating voltage to the solution and sensing the current drawn thereby.

15. The apparatus of claim 14 in which the plating and standby means comprise a power supply which provides voltages within the range of zero to two volts for both the "plating" voltage and the "standby" voltage and in which said power supply is regulated.

16. The apparatus of claim 14 which further comprises means for momentarily applying the plating voltage to the solution at periodic time intervals while the apparatus is in the standby state and sensing the current drawn thereby.

* * * * *